US007895864B2

(12) United States Patent
Hill

(10) Patent No.: US 7,895,864 B2
(45) Date of Patent: Mar. 1, 2011

(54) LAUNDRY ADDITIVE DISPENSER

(75) Inventor: Chris H. Hill, Ames, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 642 days.

(21) Appl. No.: 11/876,877

(22) Filed: Oct. 23, 2007

(65) Prior Publication Data

US 2009/0100880 A1 Apr. 23, 2009

(51) Int. Cl.
*D06F 29/00* (2006.01)
*D06F 35/00* (2006.01)
*D06F 33/00* (2006.01)

(52) U.S. Cl. ..... 68/12.18; 68/17 R

(58) Field of Classification Search ..... 68/12.18, 68/17 R

See application file for complete search history.

(56) References Cited

U.S. PATENT DOCUMENTS

| | | | | |
|---|---|---|---|---|
| 3,088,305 | A | 5/1963 | Ohmann | |
| 3,124,271 | A | 3/1964 | Beck et al. | |
| 3,757,543 | A | 9/1973 | Braga | |
| 5,253,494 | A | 10/1993 | Frucco et al. | |
| 6,463,766 | B2 | 10/2002 | Kubota et al. | |
| 6,826,933 | B2 | 12/2004 | Merkle et al. | |
| 7,093,467 | B2 | 8/2006 | Kim et al. | |
| 2003/0145633 | A1* | 8/2003 | Merkle et al. | 68/17 R |
| 2004/0011089 | A1* | 1/2004 | Rizzeto et al. | 68/17 R |
| 2004/0103696 | A1 | 6/2004 | Kim et al. | |
| 2005/0155633 | A1 | 7/2005 | Daume et al. | |
| 2005/0166645 | A1 | 8/2005 | Favret | |
| 2005/0188729 | A1 | 9/2005 | Zsambeki et al. | |
| 2005/0188730 | A1 | 9/2005 | Zsambeki | |
| 2005/0210927 | A1 | 9/2005 | Kim et al. | |
| 2005/0224098 | A1 | 10/2005 | Fujii et al. | |
| 2005/0229645 | A1 | 10/2005 | Kim et al. | |
| 2005/0229652 | A1 | 10/2005 | Kim et al. | |
| 2005/0235703 | A1 | 10/2005 | Cho | |
| 2005/0235704 | A1 | 10/2005 | Cho et al. | |
| 2005/0241347 | A1 | 11/2005 | Cho et al. | |
| 2005/0252251 | A1 | 11/2005 | Rizzetto | |

(Continued)

FOREIGN PATENT DOCUMENTS

| | | |
|---|---|---|
| CN | 1715521 | 1/2006 |

(Continued)

OTHER PUBLICATIONS

International Search Report and Written Opinion dated Mar. 10, 2009 from International application No. PCT/US2008/079475 which was filed Oct. 10, 2008.

*Primary Examiner*—Michael Barr
*Assistant Examiner*—Charles W Kling
(74) *Attorney, Agent, or Firm*—Banner & Witcoff, Ltd.

(57) ABSTRACT

An additive dispenser includes a fluid-retaining chamber. A siphoning post extends upward from a lower surface of the fluid-retaining chamber and cooperates with a cap or other structure so as to form a siphon chamber. When water is added to the chamber and a liquid level rises above an inlet to the siphoning element, a siphoning effect draws fluid from the chamber. When the siphoning effect is interrupted, any unsiphoned fluid remaining in the chamber exits by permeation through one or more porous elements located in a base of the chamber.

13 Claims, 12 Drawing Sheets

U.S. PATENT DOCUMENTS

| | | | |
|---|---|---|---|
| 2005/0262881 | A1 | 12/2005 | Rizzetto |
| 2005/0274156 | A1 | 12/2005 | Yang |
| 2006/0144424 | A1 | 7/2006 | Marchitto et al. |
| 2007/0056328 | A1 | 3/2007 | Song |
| 2007/0056329 | A1 | 3/2007 | Song |
| 2007/0056330 | A1 | 3/2007 | Song |
| 2007/0079637 | A1 | 4/2007 | Song |

FOREIGN PATENT DOCUMENTS

| | | | |
|---|---|---|---|
| CN | 1715522 | | 1/2006 |
| DE | 3637815 | | 6/1987 |
| EP | 0 249 440 | | 12/1987 |
| EP | 0318070 | | 5/1989 |
| EP | 0331920 | | 9/1989 |
| EP | 1449952 | | 8/2004 |
| EP | 1 795 643 | | 6/2007 |
| FR | 2530687 | | 1/1984 |
| FR | 2632984 | | 12/1989 |
| GB | 1 161 216 | | 8/1969 |
| GB | 2141487 | | 12/1984 |
| GB | 2187764 | | 9/1987 |
| GB | 2187764 | A * | 9/1987 |
| GB | 2 260 770 | | 4/1993 |
| JP | 63171592 | | 7/1988 |
| JP | 63270098 | | 11/1988 |
| JP | 2174898 | | 7/1990 |
| JP | 3215296 | | 9/1991 |
| JP | 10127982 | | 5/1998 |
| JP | 11347291 | | 12/1999 |
| JP | 2000342894 | | 12/2000 |
| JP | 2000342894 | A * | 12/2000 |
| KR | 2005022626 | | 3/2005 |
| KR | 2005036537 | | 4/2005 |
| KR | 2006100617 | | 9/2007 |
| KR | 2003009847 | | 1/2008 |

* cited by examiner

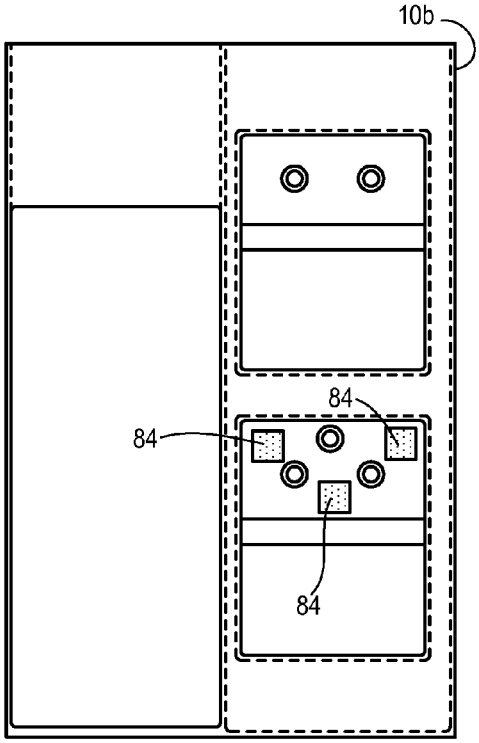
FIG. 12A
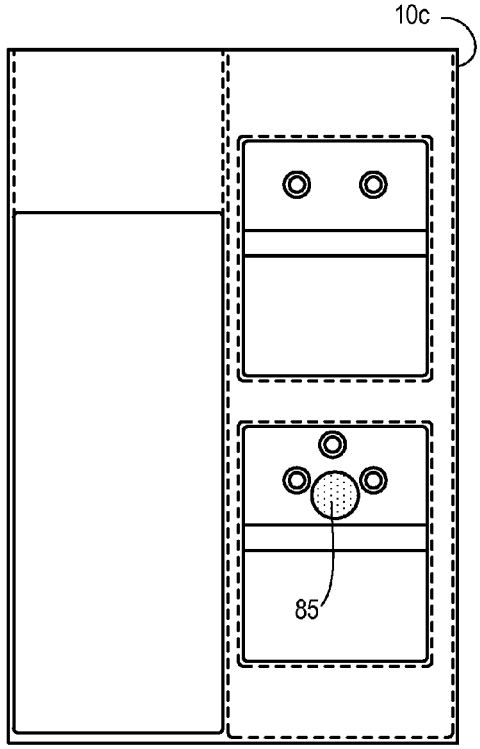
FIG. 12B
FIG. 12C
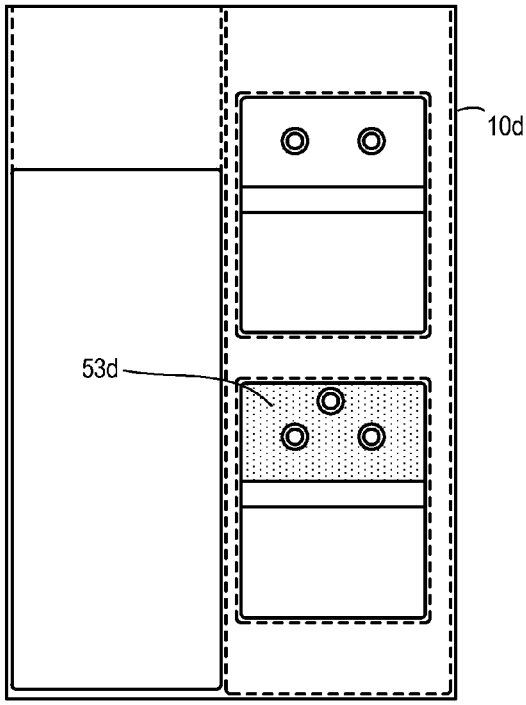

LAUNDRY ADDITIVE DISPENSER

BACKGROUND

Automated washing machines (such as laundry washing machines) often include mechanisms for dispensing additives into a washing chamber (e.g., a drum of a laundry washing machine). Some dispensers contain receptacles for different additives, which can include detergents, whiteners, fabric softeners, scents, rinse aids, etc. Typically, a user fills a dispenser chamber with one or more additives. During a wash cycle, water is then automatically introduced into the dispenser chamber and mixes with the additive. The water/additive mixture then flows into a separate washing chamber.

One type of additive dispenser is described in commonly-owned U.S. Patent Application Publication No. 2004/0011089 (titled "Washing Aid Dispenser and Washing Machine Comprising Said Dispenser"). The dispenser described in said application includes an arrangement of siphon posts positioned within a dispenser compartment. Cap pieces extend over the tops of the siphon posts. When water is introduced into the dispenser cavity and rises above the height of one or more of the siphon posts, a mixture of water and an additive is drawn from the dispenser cavity through the siphon post(s) and flows into the wash drum.

The dispenser described in U.S. Pub. No. 2004/0011089 includes multiple siphon posts of different diameters and heights in order to provide increased suction for removal of denser additives. Under some conditions, however, that dispenser (as well as other siphoning dispensers) may fail to completely evacuate a water/additive mixture from a dispenser by the end of a wash cycle. For example, some highly viscous additives can interfere with a siphoning action and interrupt flow from a dispenser cavity. When additive mixture remains after a wash cycle, the user may find it necessary to remove the entire dispenser unit to dump out the remaining mixture. In some cases, the additive mixture remains in the dispenser until the water component evaporates, thereby leaving a hardened residue.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In at least some embodiments, an additive dispenser includes a fluid-retaining chamber used to hold and dispense an additive. A siphoning post extends upward from a lower surface of the fluid-retaining chamber and cooperates with a cap or other structure so as to form a siphon chamber. When water is added to the chamber and a liquid level rises above an inlet to the siphoning post, a siphoning effect draws fluid from the chamber. When the siphoning effect is interrupted, any unsiphoned fluid remaining in the chamber exits by permeation through one or more porous elements located in a base of the chamber. In some embodiments, the additive dispenser is part of a clothes washing machine, and is used to hold and dispense liquid additives (e.g., fabric softener, liquid bleach, etc.) into a drum or other wash chamber.

BRIEF DESCRIPTION OF THE DRAWINGS

The present invention is illustrated by way of example, and not by way of limitation, in the figures of the accompanying drawings and in which like reference numerals refer to similar elements.

FIGS. 12A through 12C are top views of dispenser drawers according to additional embodiments.

DETAILED DESCRIPTION

Although various embodiments are described herein using a front-loading clothes washing (or laundry) machine as an example, the invention is not limited to front loading washers. In other embodiments, additive dispensers similar to those described herein are incorporated into top loading washing machines. The invention is not limited to laundry equipment. Additive dispensers similar to those described herein can also be used in automated dishwashing equipment, as well as in other devices. Indeed, dispensers such as those described herein can be used in devices that perform no washing function.

Figure 1:
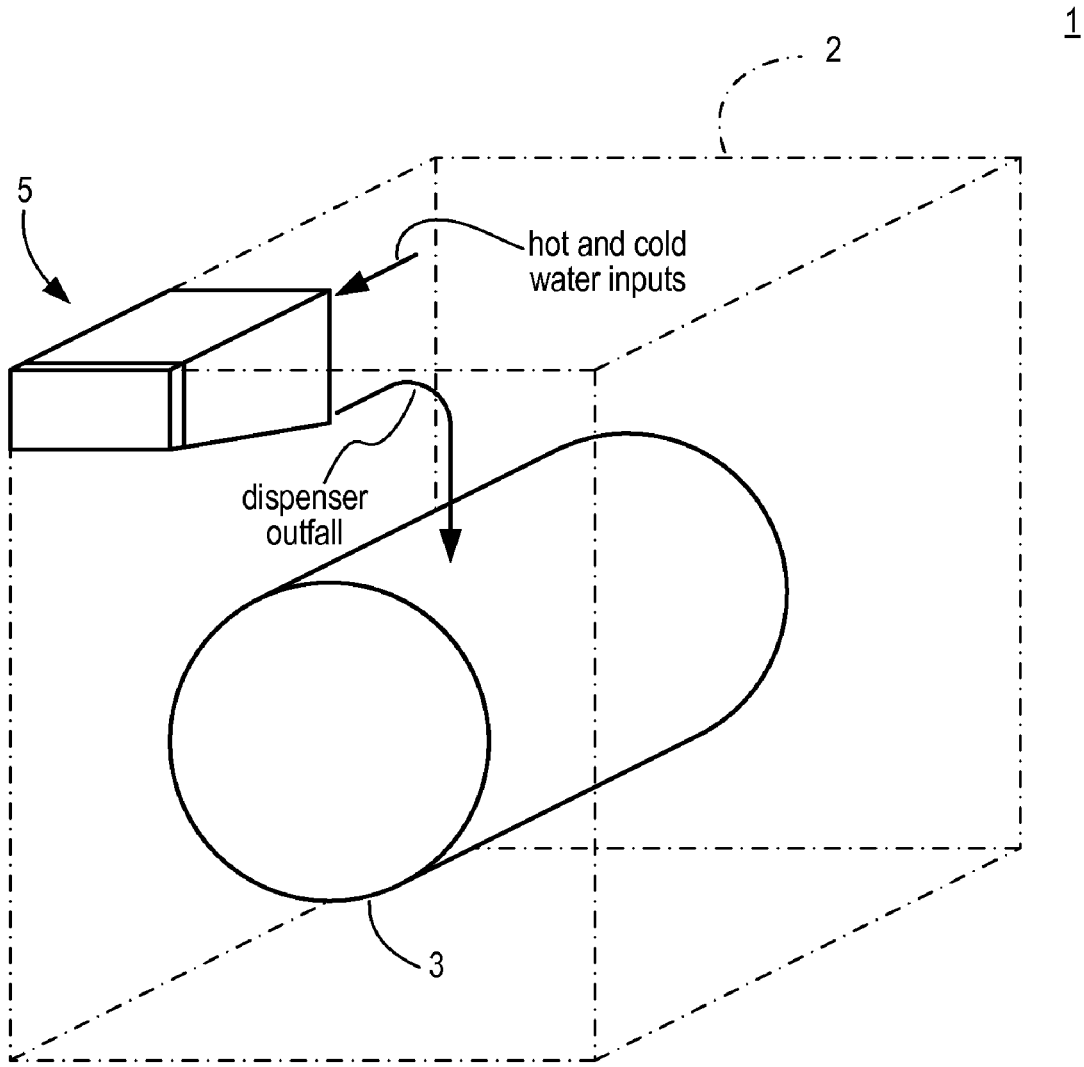
FIG. 1 is a partially schematic front perspective view of a washing machine according to some embodiments.

FIG. 1 is a partially schematic front perspective view of a clothes washing machine 1 according to at least some embodiments. The housing 2 of washing machine 1 is shown with uneven broken lines, and numerous details of washing machine 1 have been omitted so as not to obscure this description with unnecessary details. As seen in FIG. 1, washing machine 1 is of the front-loading type. Clothes or other items to be laundered are placed into a drum 3. Drum 3 is then rotated during various portions of a wash cycle by a motor (not shown). In the embodiment of FIG. 1, hot and cold water inputs are fed to a dispenser 5. The outfall from dispenser 5 then flows into drum 3. Within dispenser 5, one or more electrically-controlled valves and/or flow channels are used to direct water into drum 3. During some parts of the cycle, water bypasses various additive chambers within dispenser 5, and the outfall from dispenser 5 is water alone. During other parts of a wash cycle, and as described in more detail below, water flows through one or more chambers within dispenser 5 and mixes with additives in those chambers. As a result of said mixing, the outfall from dispenser 5 is a combination of water and one or more of the additives. During (or at the conclusion of) each wash cycle, water is drained from drum 3 via a drain line (not shown).

Figure 2:
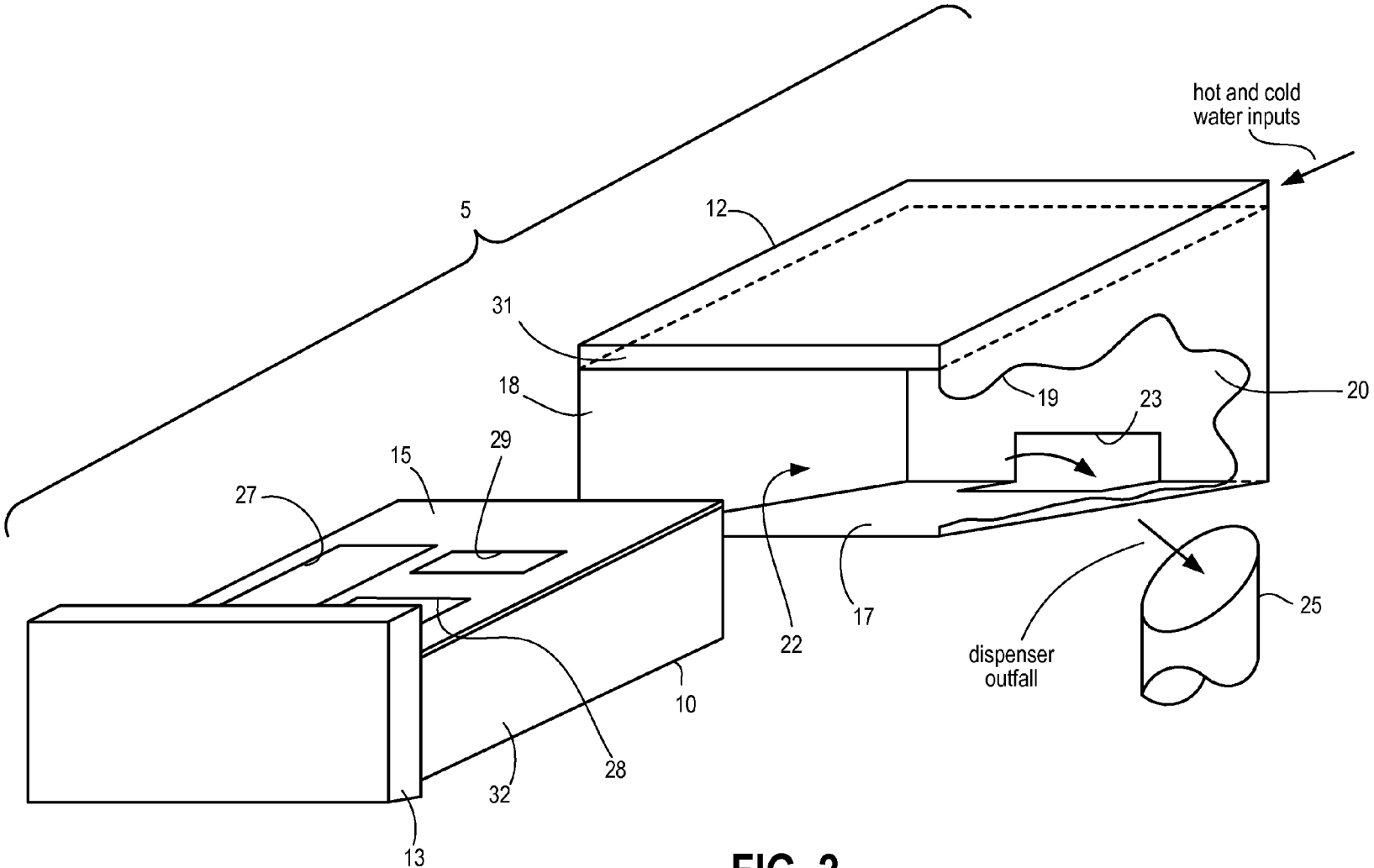
FIG. 2 is a perspective view of an additive dispenser from the washing machine of FIG. 1.

FIG. 2 shows dispenser 5 in more detail. Dispenser 5 includes a drawer 10 and drawer compartment 12. Drawer 10 is attached to a front panel 13 and includes a removable cover 15. Drawer compartment 12 includes a bottom 17, sides 18 and 19, and a rear 20. Side 19 is partially removed in FIG. 2 so as to show additional internal details. Drawer 10 and cover 15 slide into a cavity 22 formed by sides 18 and 19, bottom 17, and rear 20. With the exception of a drain region 23, the inner surfaces of sides 18 and 19, bottom 17 and rear 20 are fluid tight. When water is introduced into drawer 10 (as described below), water and/or additive flows from the rear of drawer 10. Because bottom 17 slopes downward, water and/or additive from drawer 10 flows into drain region 23. Drain region 23 is connected to an outfall tube 25 that carries water and/or additive to drum 3 (see FIG. 1).

As explained in more detail below, three separate chambers are formed in drawer 10. One of those chambers can hold and dispense powdered detergent, and the other two chambers can hold and dispense liquid additives (e.g., fabric softener and bleach). Openings corresponding to each of the three chambers in drawer 10 are formed in cover 15. Specifically, a first opening 27 is positioned over the chamber used to hold and dispense powdered detergent. Liquid detergent may also be dispensed through the use of an insertable cup and cover assembly, as will be described below in conjunction with FIGS. 14-17. A second opening 28 is positioned over the chamber used to hold and dispense fabric softener, and a third opening 29 is positioned over the chamber used to hold and dispense liquid bleach.

When drawer 10 and cover 15 are fully inserted into drawer compartment 12 (as shown in FIG. 1), a water flow control assembly 31 selectively introduces water into one or more of openings 27, 28 and 29. Water flow control assembly 31 is also configurable (e.g., during a rinse cycle) to bypass drawer 10 by directing water between the left side of drawer 10 (i.e., the side not visible in FIG. 2 and that is opposite to right side 32) and the inner surface of side 18 of drawer compartment 12. In some embodiments, water flow control assembly 31 includes a water-conveying tray with groups of holes that are positioned over openings 27, 28 and 29 when drawer 10 and cover 15 are inserted into drawer compartment 12, as well as a group of holes located over the region between the left side of drawer 10 and the inner surface of compartment side 18. A plurality of channels are also formed in the water-conveying tray so as to direct water over an appropriate group (or groups) of holes for dispensing a selected additive during a particular wash cycle. Solenoid valves are coupled to the hot and cold water inputs, and are selectively operated (either individually or in various combinations) so as to direct water through the appropriate channel(s). Such water flow control assemblies are known in the art. One example of a tray-type water flow control assembly having a plurality of channels and hole groupings is described in U.S. Pat. No. 6,227,012 (titled "Device for Housing Detergents and/or Other Washing Agents Which Can Be Used in a Washing Machine, Preferably in a Machine for Washing Laundry). In other embodiments, different water control mechanisms can be used. For example, a separate tubing output could be placed in each of the locations within drawer compartment 12 that corresponds to one of openings 27, 28 and 29 and to the drawer bypass location, with a separate solenoid valve placed in a fluid flow path between each tubing output and the hot and/or cold water inputs.

Figure 3:
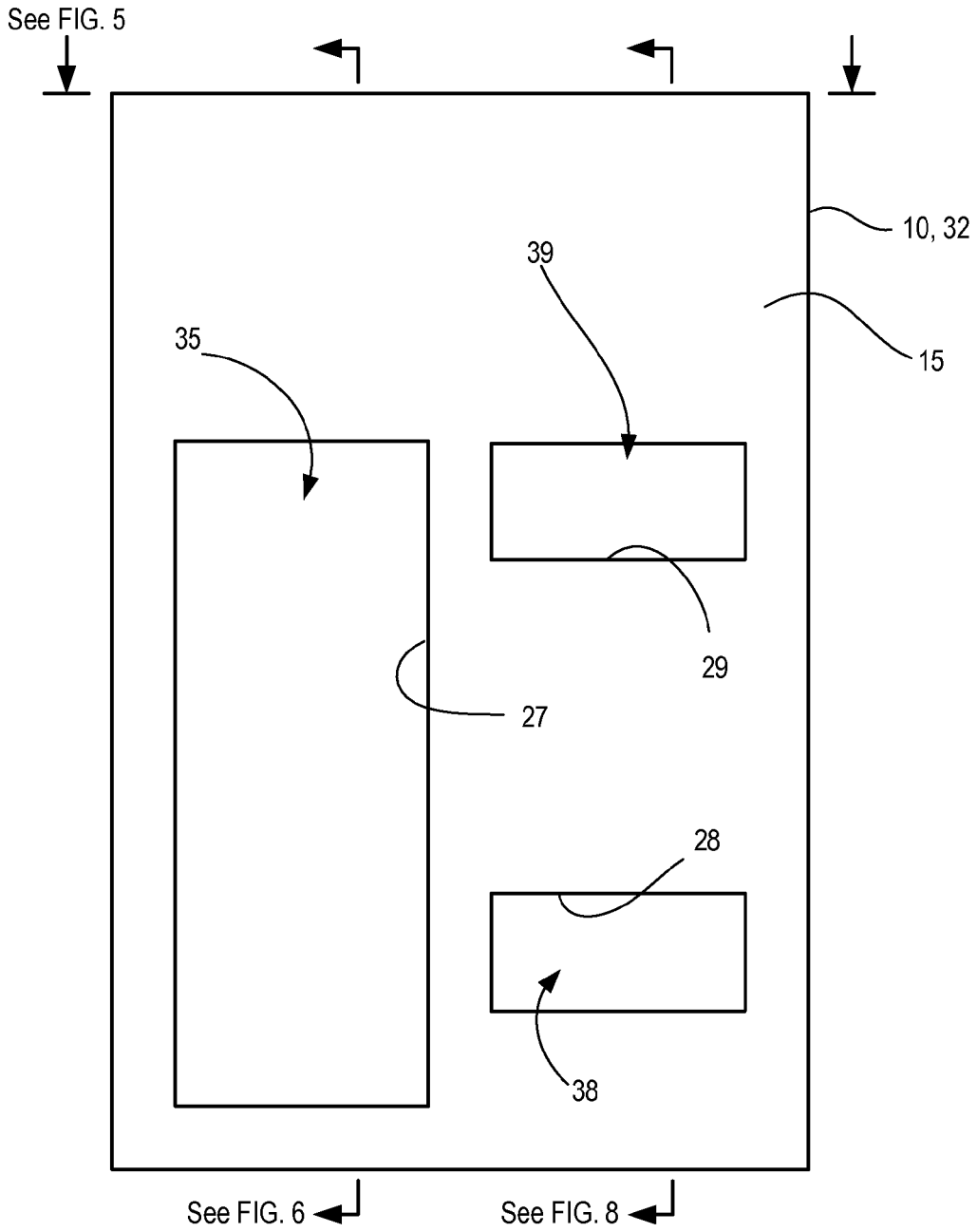
FIG. 3 is a top view of a drawer from the dispenser of FIG. 2.
Figure 4:
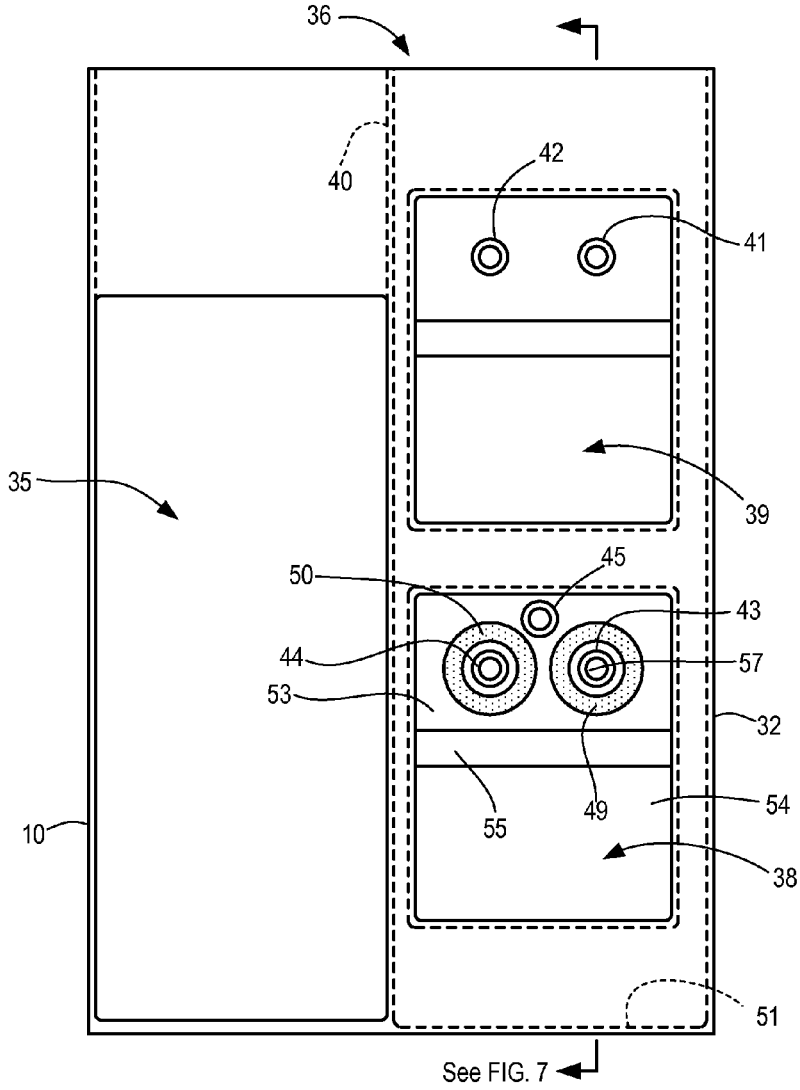
FIG. 4 is a top view of a drawer from the dispenser of FIG. 2, and with a cover removed.
Figure 5:
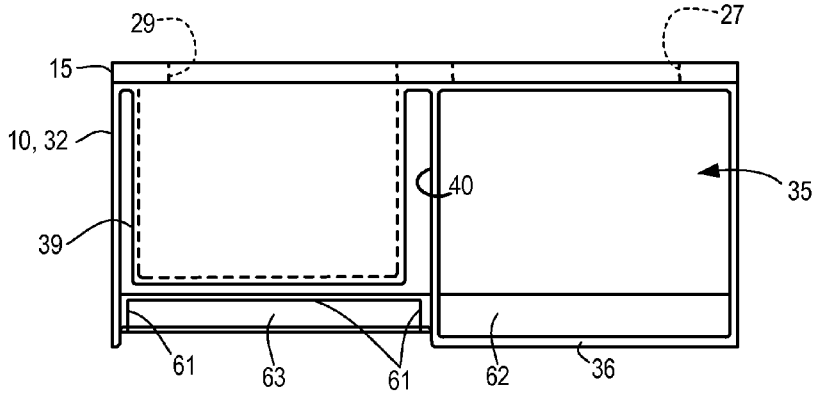
FIG. 5 is an end view of a drawer from the dispenser of FIG. 2, which end view is from the location shown in FIG. 3 and rotated by 180°.

FIG. 3 is a top view of drawer 10 with cover 15 attached. FIG. 4 is a top view of drawer 10 with cover 15 removed. For simplicity, front panel 13 is omitted from FIGS. 3 and 4, as well as from subsequent drawings. FIG. 5 is an end view of drawer 10 and cover 15 taken from the location shown in FIG. 3, and is rotated by 180° so as not to be upside down. As seen in FIG. 5 and as explained below in connection with FIGS. 6-9, chamber 35 is open at the rear 36 of drawer 10. A removable base 63 is attached (along snap-fit lines 61) to the underside of drawer 10 under chambers 38 and 39. Such separately-formed and attached pieces may be necessary or desirable from a manufacturing standpoint (e.g., to facilitate removal of the pieces from the molds of an injection molding apparatus). As seen in FIG. 5, and as also seen in FIG. 9, base 63 does not extend all the way to rear 36 of drawer 10 in some embodiments. Base 62 of chamber 35 is formed as an integral part of drawer 10, and does extend all the way to rear 36 (in some embodiments).

Opening 27 in cover 15 is located over chamber 35. By introducing water into chamber 35 through opening 27, powdered detergent in chamber 35 is carried into drawer compartment 12 (see FIG. 2) and into drum 3 (FIG. 1). Openings 28 and 29 in cover 15 are located over chambers 38 and 39, respectively. As described below in connection with FIG. 7, chambers 38 and 39 are generally in the shape of tanks with open tops. Fluid cannot flow out of the sides of chambers 38 and 39. Instead, and in a manner described below, fluid exits chamber 39 through siphon posts 41 and 42. As is also described below, fluid exits chamber 38 through siphon posts 43, 44 and 45, as well as through porous elements 49 and 50. As previously indicated, drawer 10 is in some embodiments formed from injected-molded plastic. Broken lines in FIGS. 4 and 5 are used to impart a sense of thickness to the walls of chambers 35, 38 and 39, as well as to a front wall 51 of drawer 10.

Figure 6:
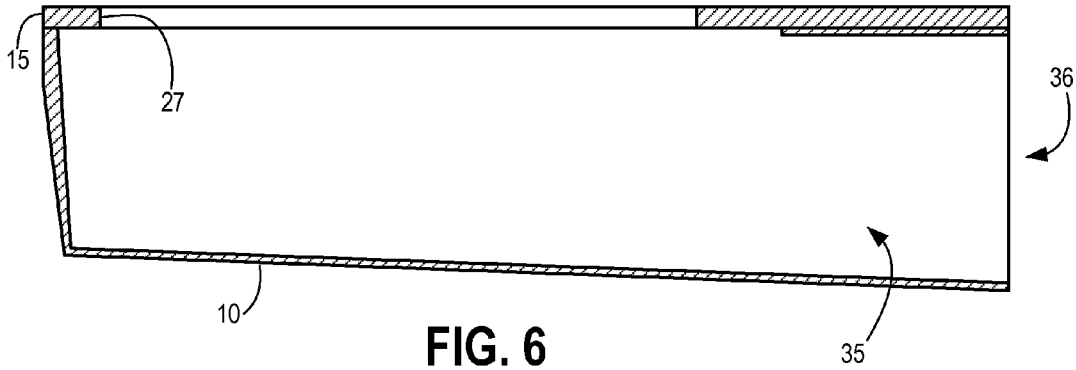
FIG. 6 is a cross-sectional view taken from the location indicated in FIG. 3.

FIG. 6 is a cross-sectional view of drawer 10 taken from the location indicated in FIG. 3. Chamber 35 is open at the rear 36 of drawer 10. In operation, chamber 35 is used to hold and dispense powdered detergent. Specifically, powdered detergent is placed into chamber 35 through cover opening 27 when drawer 10 is pulled from drawer compartment 12. After drawer 10 and cover 15 are replaced into drawer compartment 12 and a wash cycle begins, water is introduced into chamber 35 (also through opening 27) from water control assembly 31. That water mixes with powdered detergent and carries the powdered detergent out of drawer 10 through the open rear 36.

Figure 7:
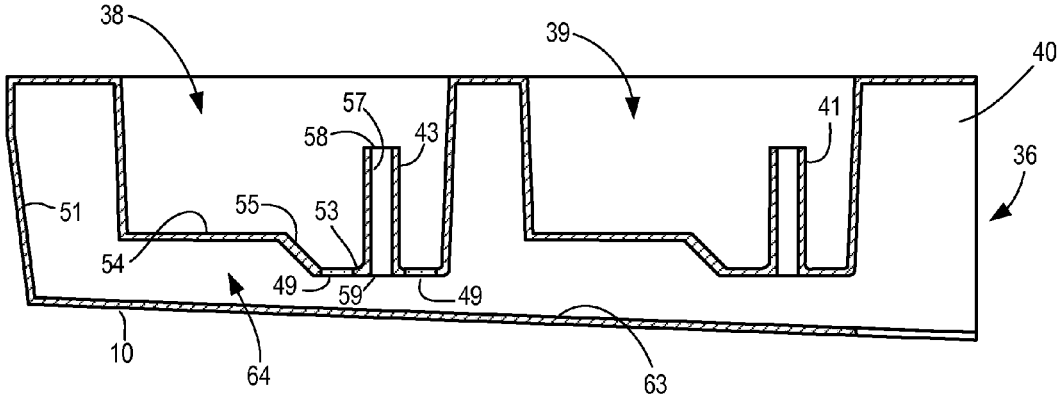
FIG. 7 is a cross-sectional view taken from the location indicated in FIG. 4.

FIG. 7 is a cross-sectional view of drawer 10 taken from the location indicated in FIG. 4. Chamber 38 forms a generally rectangular tank with a deeper recessed region 53 and a shallower region 54, with regions 53 and 54 joined by a sloping region 55. Siphon posts 43, 44 and 45 are located in recessed region 53. Siphon post 44 is behind siphon post 43; siphon post 45 is omitted from FIGS. 7-10 for clarity. As seen in FIG. 7, siphon post 43 includes a central bore 57 that extends from an inlet 58 at the top of siphon post 43 to an outlet 59 on the underside of chamber 38. Porous element 49 is annularly shaped and located in recessed region 53 around the base of siphon post 43. The purpose of porous element 49 (and of porous element 50) is discussed below. Siphon posts 44 and 45 (FIG. 4) are similar to siphon post 43. In the embodiment shown, a porous element 50 is also located around the base of siphon post 44. The walls of chamber 38, regions 54, 55 and 53 (except for porous elements 49 and 50), and the sides of siphon posts 43, 44 and 45 are non-porous. Chamber 39 is generally similar to chamber 38, except that chamber 39 only includes two siphon posts 41 and 42, and chamber 39 lacks porous elements. Base 63 of drawer 10 is removably attached to wall 40 of chamber 35, to the forward end 51 of drawer 10, and to side wall 32 (see FIGS. 2, 4 and 5). In this manner, a downwardly sloping cavity 64 is formed, and fluid exiting chambers 38 and 39 flows through cavity 64 and out of drawer 10 slightly ahead of rear 36 (see FIG. 9).

Figure 8:
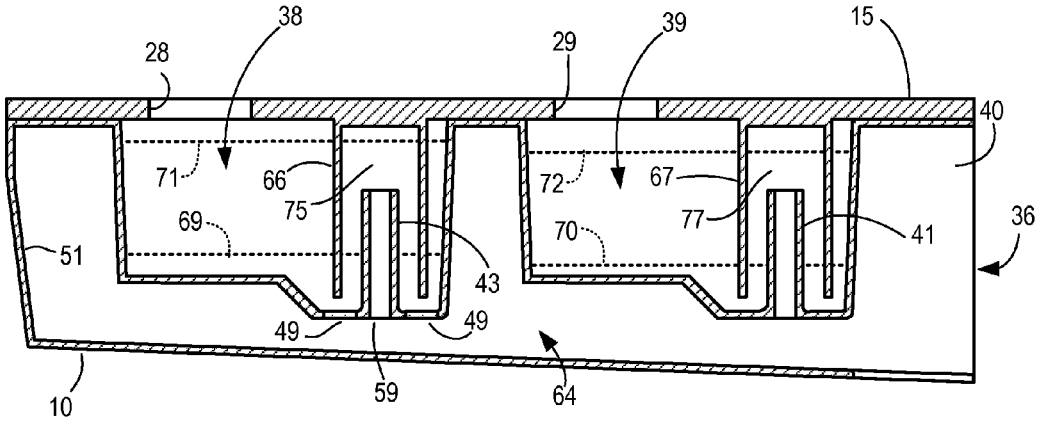
FIG. 8 is a cross-sectional view taken from the location indicated in FIG. 3.
Figure 9:
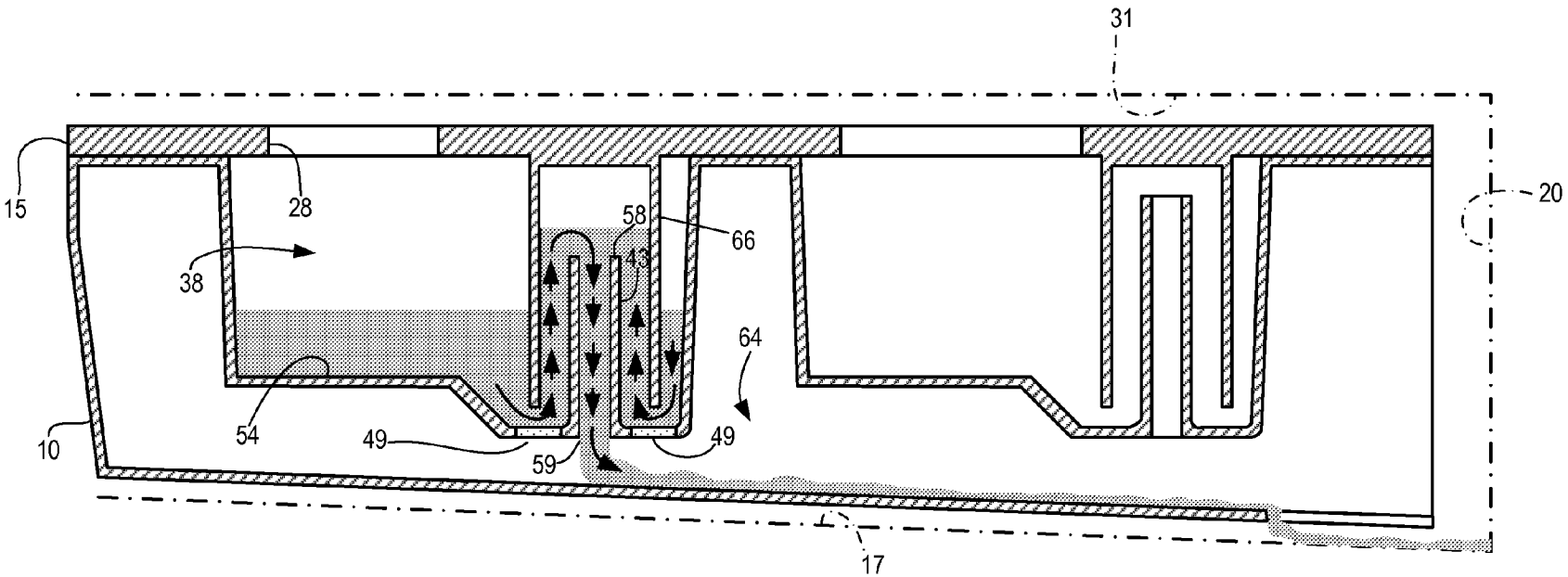
FIG. 9 is an enlarged view of the dispenser drawer shown in FIG. 8.

FIG. 8 is a cross-sectional view taken from the location shown in FIG. 3, and shows drawer 10 with cover 15 in place. A cap 66 is attached to the underside of cover 15 and is positioned over siphon post 43. A cap 67 (also attached to the underside of cover 15) is positioned over siphon post 41. Additional caps (not shown) are also attached to the underside of cover 15 and similarly positioned over siphon posts 42, 44 and 45. Chambers 38 and 39 are used to hold and dispense liquid additives. In the embodiment shown, chamber 38 is used to hold and dispense relatively viscous fluid additives (e.g., fabric softener). Chamber 39 is used to hold and dispense less viscous additives (e.g., liquid bleach). In operation, a user pours liquid additives into chambers 38 and 39 through openings 28 and 29 when drawer 10 and attached cover 15 are pulled outwardly to extend from drawer compartment 12. By way of example, broken lines 69 and 70 indicate the fill levels of fabric softener (chamber 38) and bleach (chamber 39) added by a user. Actual indicia indicating a desirable fill level may be provided, but are not required. Rather, the additive fill level(s) may be any marked or unmarked fill level below the top of the siphon post, so as to avoid commencement of siphoning action prior to the desired dispensing time.

After drawer 10 and attached cover 15 are pushed back into drawer compartment 12, and during appropriate times in the wash cycle, water is introduced into chamber 38 (through opening 28) and into chamber 39 (through opening 29). By way of further example, broken line 71 indicates a level of water and fabric softener mixture after water is added to chamber 38. Similarly, broken line 72 indicates a level of water and bleach mixture after water is added to chamber 39. As water is added to chamber 38 and the liquid level rises above the top of siphon post 43 (and thus above the inlet 58 of bore 57), a siphoning effect occurs within a siphon chamber 75 formed between the inner wall of cap 66 and the outer wall of siphon post 43. This siphon effect then draws liquid from chamber 38 and releases that liquid through outlet 59 of bore 57 into cavity 64, with said liquid then flowing from drawer 10 into drawer compartment 12 along bottom 63. In a similar manner, siphoning effects within siphon chambers (not shown in FIG. 8) formed about siphon posts 44 and 45 draw liquid from chamber 38 and release liquid (through outlets of bores of siphon posts 44 and 45) into cavity 64. Liquid is drawn from chamber 39 in a similar fashion through a siphon chamber 77 formed by cap 67 and siphon post 41, as well as through a siphon chamber formed by a cap located over siphon post 42 (not shown in FIG. 8).

Figure 10:
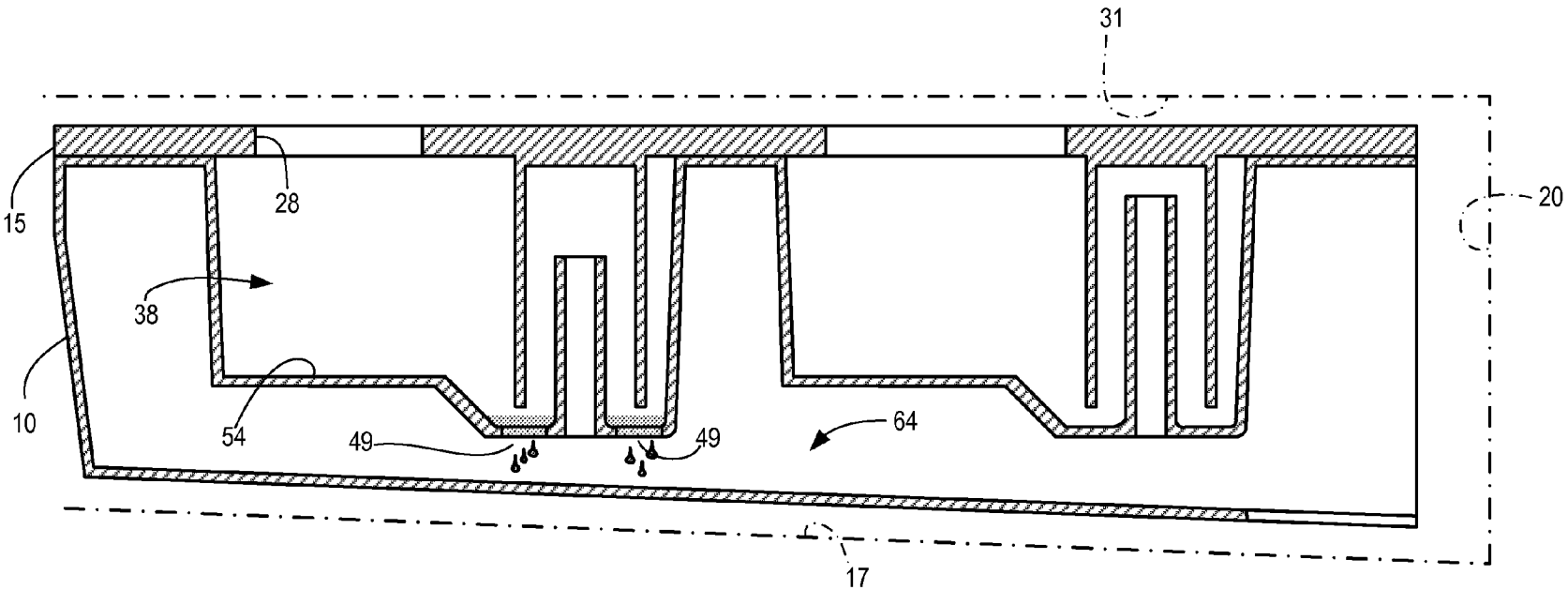
FIG. 10 is another enlarged view of the dispenser drawer shown in FIG. 8.

FIGS. 9 and 10 are enlarged views of drawer 10 and cover 15 from FIG. 8. Shown in uneven broken lines are the approximate locations (when drawer 10 and cover 15 are pushed back into drawer compartment 12) of the underside of water flow control assembly 31, the inner surface of rear 20, and the upper surface of bottom 17. The solid-shaded regions in FIGS. 9 and 10 represent a liquid (e.g., a water and fabric softener mixture). Because of the siphoning effect, liquid can be drawn from chamber 38 even after the liquid level in chamber 38 drops well below inlet 58 at the top of siphon post 43. This is shown in FIG. 9, where liquid drawn from chamber 38 flows along bottom 63 and is discharged from drawer 10 into drawer compartment 12. Once the level of liquid drops below the bottom edge of cap 66, the siphon-effecting air seal is broken, thereby leaving some liquid in the bottom of chamber 38 (FIG. 10). If the unsiphoned liquid is allowed to remain in chamber 38, the user may undesirably encounter the residual liquid upon opening drawer 10 for the next wash. In addition, the water in that liquid may evaporate and leave behind an encrusted residue. Over time, such residue could accumulate and interfere with operation of chamber 38.

So as to reduce and/or eliminate residual liquid and solidified residue formation and accumulation, porous elements 49 and 50 (seen in FIG. 4) are included in recessed region 53 of chamber 38. Elements 49 and 50 are formed from a material which allows a liquid to slowly permeate, thereby draining any liquid that remains in chamber 38 after a siphoning effect is interrupted. This is shown in FIG. 10, wherein liquid within chamber 38 is slowly seeping through porous element 49. Because liquid does not quickly penetrate porous elements 49 and 50, however, chamber 38 is able to substantially retain the additive for deferred delivery at the appropriate time during the wash process (i.e., when water is introduced to raise the liquid level above the tops of siphon posts 43, 44 and 45, thereby permitting a siphoning effect to begin).

Porous elements 49 and 50 may be formed from any of a variety of materials, and may include a filter mesh and/or a permeable membrane. In some embodiments, for example, porous elements are created by gluing (with a cyanoacrylic adhesive) sections of woven mesh material over cutouts in the bottom of an additive chamber. In other embodiments, one or more porous inserts may be directly formed in the bottom of an additive chamber during an injection molding operation. Optimal pore size and overall area of a porous element will vary based on the types of additives a particular dispensing chamber is designed to hold. For many common laundry additives, a porous element having a pore size of approximately 50 microns and an overall area of approximately 9 mm by 3 mm will retain an undiluted additive (i.e., concentrated additive before water is added during a wash cycle) for several hours, but will allow an additive and water mixture to drain from the chamber in a shorter time period. For example, undiluted ALL® SMALL AND MIGHTY® 3×concentrated laundry detergent (produced by Unilever United States Inc. of Englewood Cliffs, N.J.) placed into a chamber having a 9 mm by 3 mm section of 193×193 precision woven nylon mesh (0.0020 inch diameter threads and 0.0031 inch openings, and available from McMaster-Carr Supply Company of Chicago, Ill. under part number 9318T22) in its bottom surface will drip out at a rate of approximately 1 drop every 15 seconds for the first 20 minutes and slowing to 1 drop every 40 seconds thereafter. Of course, other types of materials could be used (e.g., polyester, polypropylene, metal or metal alloys.

Selecting an appropriate porous element material and overall porous material area for a given additive (or group of additives) and for a given retention time (e.g., so as to prolong full discharge of the undiluted additive by an hour or more) is within the routine ability of persons skilled in the art once such persons are provided with the information contained in this written description. In some embodiments, porous elements can be chosen so as to retain undiluted and concentrated additive (having a higher viscosity) for a long period of time without significant leakage, but to permit a water-diluted additive (having a lower viscosity) to completely drain from the chamber during a wash cycle. In still other embodiments, one porous element within a dispenser chamber may have a different permeability than another porous element in the same dispenser chamber.

Figure 11:
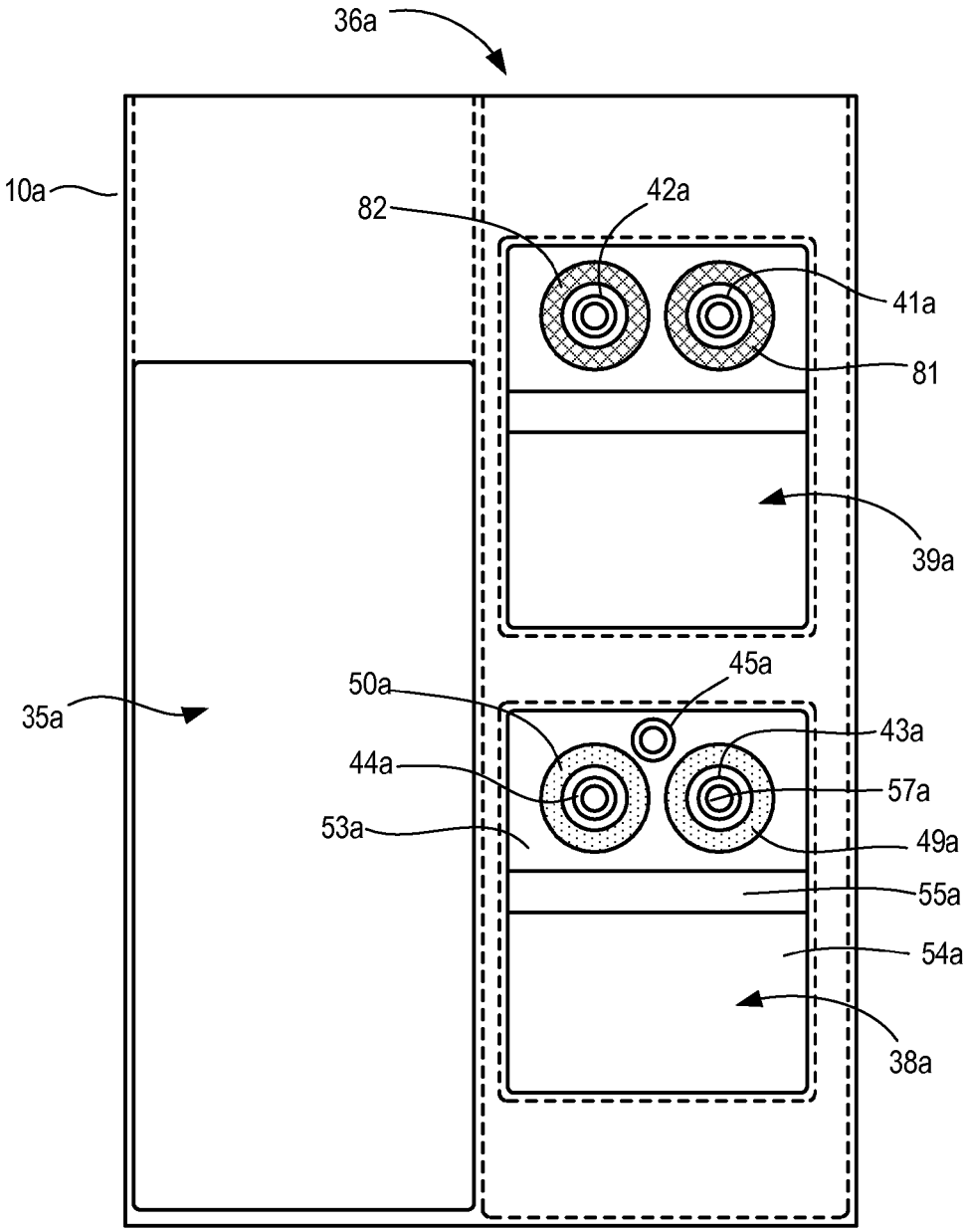
FIG. 11 is a top view of a dispenser drawer according to at least some additional embodiments.

In the embodiment of FIGS. 9 and 10, porous elements are only included in chamber 38. This configuration may be useful where, e.g., chamber 39 (which lacks porous inserts) is intended for dispensing of liquid bleach or other additives which are not highly viscous and/or which do not leave a significant residue upon evaporation. In some embodiments, however, porous elements can be included in both chambers. One example is shown in drawer 10*a* in FIG. 11. Drawer 10*a* is similar to drawer 10 of FIGS. 1-10, and similar components have reference numbers differentiated by an appended lower case "a" (e.g., siphon post 43 of FIG. 4 corresponds to siphon post 43*a* of FIG. 11). Unlike drawer 10 of FIGS. 1-10, however, drawer 10*a* in FIG. 11 includes porous elements 81 and 82 in chamber 39*a*. Moreover, porous elements 81 and 82 are formed from a material that is slightly less permeable than the material used for porous elements 49*a* and 50*a* in chamber 38*a*, thereby facilitating deferred draining of less viscous water/additive mixtures that might remain unsiphoned.

Numerous other variations on the above concepts can be implemented in additional embodiments. For example, a porous element need not be in the shape of an annulus surrounding a siphon post. In some embodiments, porous elements can be round, square or of other shapes, and can be of various numbers and distribution. Some examples of such embodiments are shown in FIGS. 12A and 12B. In FIG. 12A, a drawer 10*b* is similar to drawer 10 of FIGS. 1-10, except that square porous elements 84 are used instead of annular porous elements 49 and 50. In FIG. 12B, a drawer 10*c* is also similar to drawer 10 of FIGS. 1-10, except that a single round porous element 85 is used instead of annular porous elements 49 and 50. In yet other embodiments, the entire recessed region of a dispenser chamber is formed from a porous element (as shown for drawer 10*d* in FIG. 12C). In yet other embodiments, the entire lower surface of a dispenser chamber (e.g., the surfaces of regions 53, 54 and 55 in FIGS. 4, 6 and 7) are porous; the lower surface (or portions thereof) need not be flat. In still further embodiments, a dispenser implementing one or more of the above-described aspects may include a drawer having more than three chambers or less than three chambers. The number of siphoning elements may also vary. Indeed, the invention is not limited to implementation in a dispenser having a drawer/drawer compartment configuration.

Figure 13:
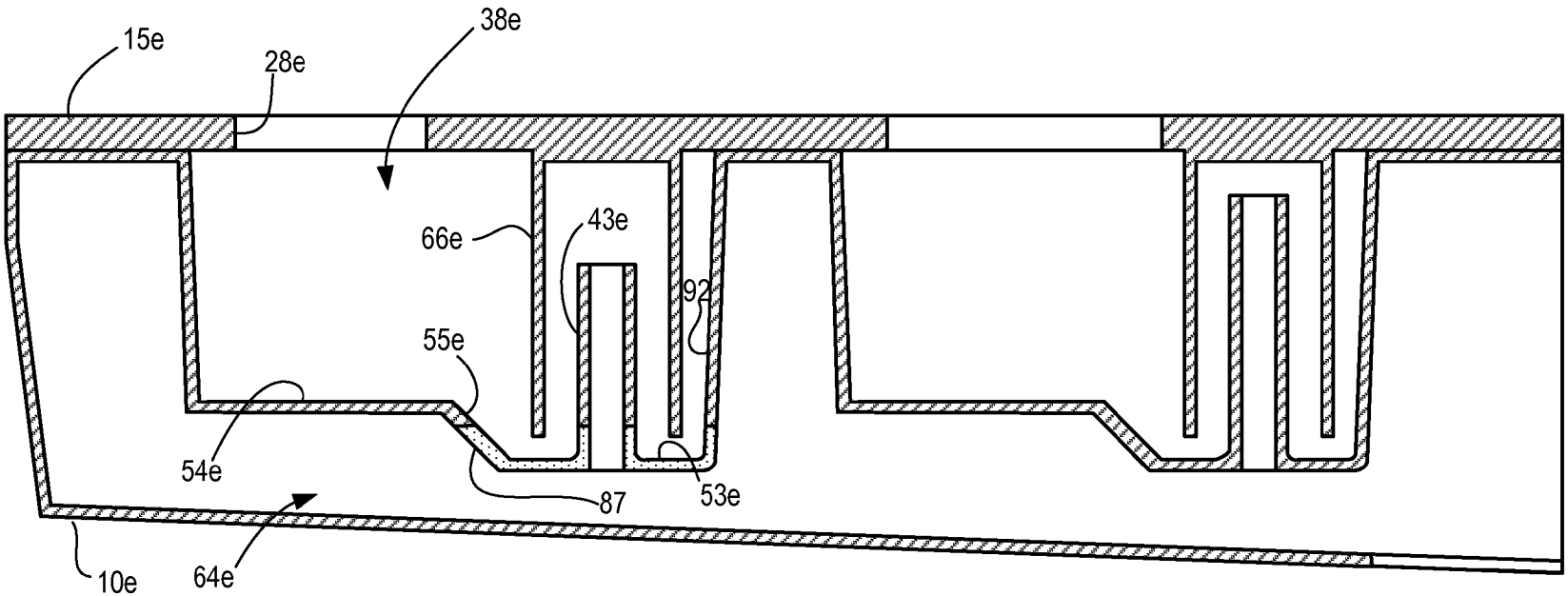
FIG. 13 is a cross-sectional view of a dispenser drawer according to another embodiment.

In still further embodiments, a lower portion of one or more siphon posts and/or of one or more dispenser chamber walls may be porous. One example of such an embodiment is shown in FIG. 13, a cross-sectional view of a dispenser drawer 10*e* according to another embodiment. Drawer 10*e* is similar to drawer 10 of FIGS. 1-10, and similar components have reference numbers differentiated by an appended lower case "e" (e.g., siphon post 43 of FIG. 4 corresponds to siphon post 43*e* of FIG. 11). In the embodiment of FIG. 13, the lower portion of siphon post 43*e*, a lower portion of a back rear wall 92, region 53*e* and a portion of region 55*e* are formed from a porous material 87. In other embodiments, only the lower portions of one or more siphon posts and/or of the chamber walls are porous.

Figure 14:
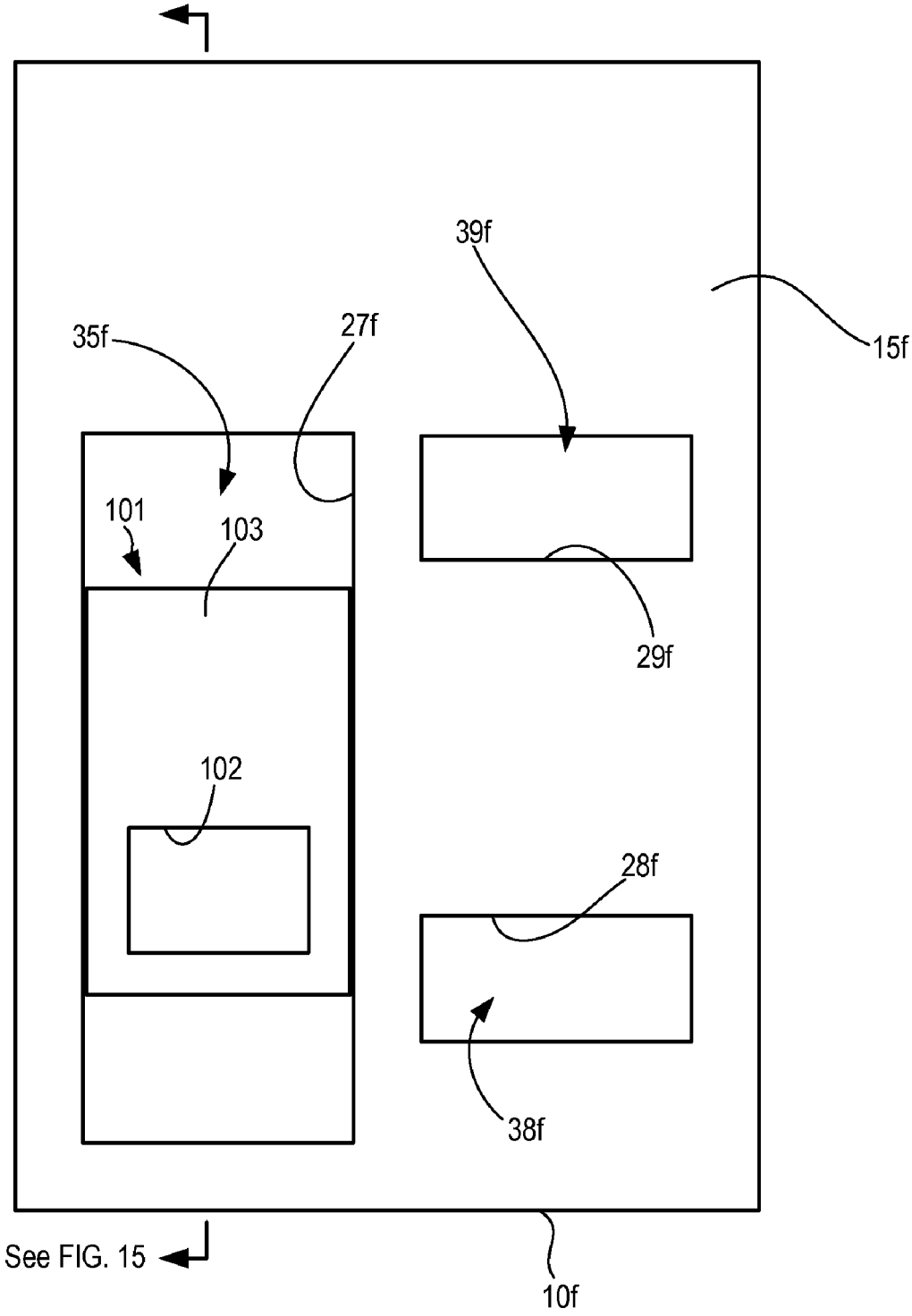
FIG. 14 is a top view of a dispenser drawer according to an embodiment that includes an insert for dispensing of liquid detergent.
Figure 15:
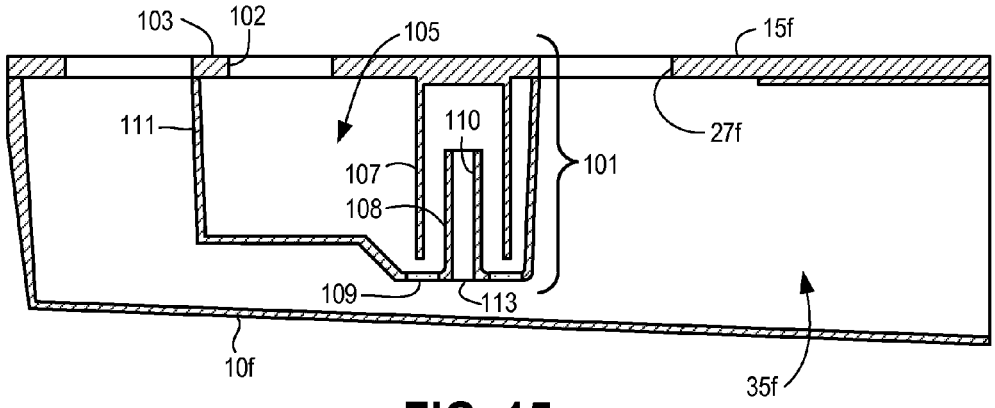
FIG. 15 is a cross-sectional view taken from the location shown in FIG. 14.

As previously indicated, some embodiments include an insertable cup and cover assembly that can be used to dispense liquid detergents. FIG. 14 is a top view of a dispenser drawer 10*f* according to one such embodiment. Drawer 10*f* is similar to drawer 10 of FIGS. 1-10, and similar components have reference numbers differentiated by an appended lower case "f." As with the embodiment of FIGS. 1-10, chamber 35*f* of drawer 10*f* can be used to dispense powdered detergent. However, cup/cover assembly 101 can alternatively be inserted and used to dispense liquid detergent. FIG. 15 is a cross-sectional view of drawer 10*f* and of cup/cover assembly 101 from the location shown in FIG. 14. Assembly 101 includes a cup 111 and a cover 103. Cover 103 is attached to cup 111 (e.g., by a snap fit), and cap/cover assembly 101 is removably attached (e.g., via another snap fit, via a lip formed around a portion of opening 27*f*, etc.) to drawer cover 15*f* within opening 27*f*. In other embodiments, cup/cover assembly 101 is attached to drawer 10*f* in another manner (e.g., by resting on a pedestal formed within chamber 35*f*). Similar to chamber 38 of FIGS. 4 and 7-10, cup 111 forms an internal chamber 105 having a siphon post 108 located in a recessed region. A bore 110 extends from an inlet at the top of post 108 to an outlet 113 on the underside of cup 111. A cap 107 is attached to an underside of cover 103 and creates a siphon chamber around the upper portion of siphon post 108.

A porous insert 109 is located around the base of siphon post 108. Although only a single siphon post, cap and porous insert are shown, cup/cover assembly 101 can include multiple posts, caps and porous inserts.

Figure 16:
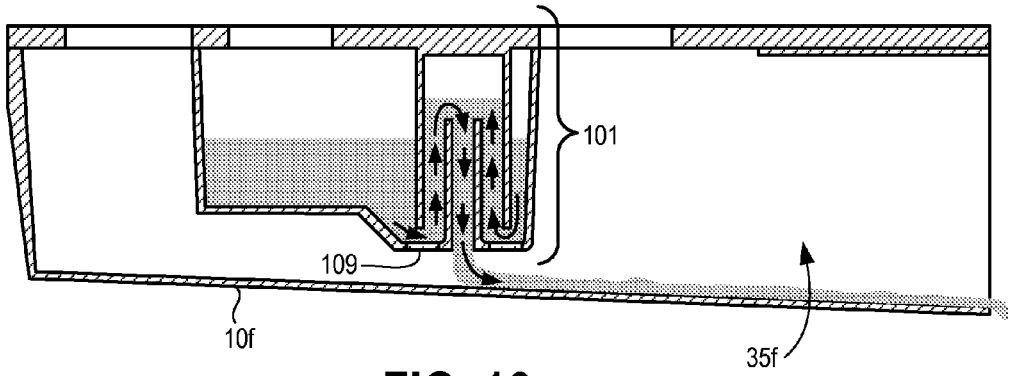
FIGS. 16 and 17 are cross-sectional views similar to FIG. 15, but showing dispensing of a liquid detergent additive.
Figure 17:
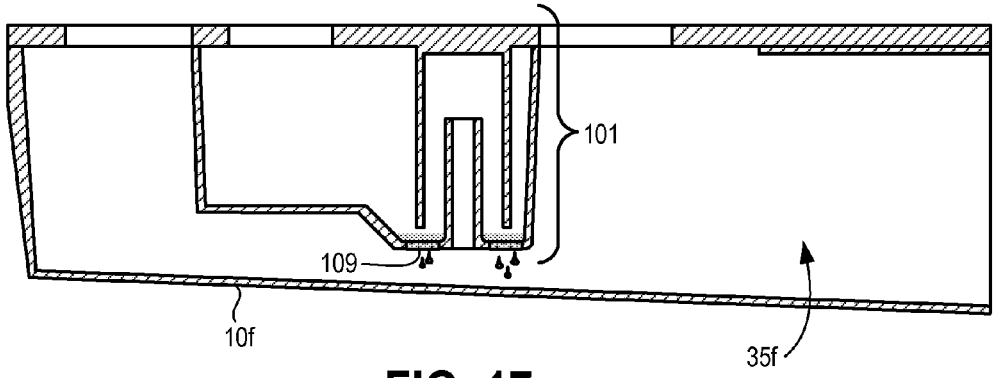

In operation, a user pours liquid detergent into chamber 105 through opening 102 in cover 103. After pushing drawer 10*f* into a drawer compartment (similar to compartment 12 shown on FIG. 2), and during an appropriate portion of the wash cycle, water is introduced into chamber through opening 102. This raises the liquid level in chamber 105, and ultimately causes siphoning through post 108 to begin. As shown in FIG. 16, this siphoning continues and draws liquid from chamber 105 into chamber 35*f*, from where the liquid then flows into the wash drum in a manner similar to that described above. After most of the liquid has been drained through the siphoning action, remaining liquid seeps out through porous element 109 (FIG. 17).

In still other embodiments, a fluid removal device other than a siphon post is used. In some such embodiments, a first fluid removal component (e.g., a tube coupled to a pump or other vacuum source) has an inlet within a fluid-retaining chamber. The inlet is in fluid communication with an outlet located external from the fluid-retaining chamber. A porous element has a portion located in the fluid-retaining chamber, and serves as a secondary fluid removal component.

Numerous characteristics, advantages and embodiments of the invention have been described in detail in the foregoing description with reference to the accompanying drawings. However, the above description and drawings are illustrative only. The invention is not limited to the illustrated embodiments, and all embodiments of the invention need not necessarily achieve all of the advantages or purposes, or possess all characteristics, identified herein. Various changes and modifications may be effected by one skilled in the art without departing from the scope or spirit of the invention. The elements and uses of the above-described embodiments can be rearranged and combined in manners other than specifically described above, with any and all permutations within the scope of the invention. As used herein (including the claims), "in fluid communication" means that fluid can flow from one component to another; such flow may be by way of one or more intermediate (and not specifically mentioned) other components; and such may or may not be selectively interrupted (e.g., with a valve). As also used herein (including the claims), "coupled" includes two components that are attached (movably or fixedly) by one or more intermediate components.

The invention claimed is:

1. A washing machine, comprising:

a washing chamber;

one or more water inputs;

an additive dispenser coupled to the one or more water inputs, the additive dispenser including a fluid-retaining chamber and being configured so that an outfall of the additive dispenser can flow into the washing chamber, the fluid-retaining chamber including a bottom surface and an opening for receiving water supplied by the one or more water inputs;

a siphoning element having a base coupled to the bottom surface and extending upward therefrom, the siphoning element including an upper portion and a fluid pathway from the upper portion to a region external to the fluid-retaining chamber;

an enclosure positioned over the siphoning element so as to form a siphon chamber for effecting siphon dispensing of liquid from the fluid-retaining chamber; and a porous element having an exposed portion in the bottom surface of the fluid-retaining chamber and positioned so as to allow liquid remaining in the fluid-retaining chamber following said siphon dispensing to permeate through the porous element and exit the fluid-retaining chamber, wherein the porous element is configured to permit permeation by a first liquid at a first rate and to permit permeation by a mixture of the first liquid and water at a second rate, the first liquid is more viscous than the mixture, and the first rate is slower than the second rate.

2. The washing machine of claim 1, wherein the porous element is located entirely within the bottom surface and the porous element is of a fixed size.

3. The washing machine of claim 1, wherein the bottom surface includes a region that is recessed relative to other regions of the bottom surface, wherein the siphoning element base is positioned in the recessed region, and wherein the porous element is also located within the recessed region.

4. The washing machine of claim 1, further comprising:

a second siphoning element having a base coupled to the bottom surface and extending upward therefrom, the second siphoning element including an upper portion and a fluid pathway from the upper portion to the region external to the fluid-retaining chamber; and a second enclosure positioned over the second siphoning element so as to form a second siphon chamber for effecting siphon dispensing of liquid from the fluid -retaining chamber.

5. The washing machine of claim 4, further comprising a second porous element in the bottom surface, the second porous element having an exposed portion in the fluid-retaining chamber and positioned so as to allow liquid remaining in the fluid-retaining chamber following the siphon dispensing through the second siphon chamber to permeate through the second porous element.

6. The washing machine of claim 1, further comprising:

a second fluid-retaining chamber having a second bottom surface;

a second siphoning element having a base coupled to the second bottom surface and extending upward therefrom, the second siphoning element including an upper portion and a fluid pathway from the upper portion to a region external to the second fluid-retaining chamber; and an enclosure positioned over the second siphoning element so as to form a second siphon chamber for effecting siphon dispensing of liquid from the second fluid-retaining chamber.

7. The washing machine of claim 6, further comprising a second porous element having an exposed portion in the second fluid-retaining chamber and positioned so as to allow liquid in the second fluid-retaining chamber following the siphon dispensing through the second siphon chamber to permeate through the second porous element and exit the second fluid-retaining chamber.

8. The washing machine of claim 1, wherein the porous element is located entirely within the bottom surface.

9. The washing machine of claim 1, wherein the porous element is of a fixed size.

10. The washing machine of claim 1, wherein the additive dispenser further includes first and second portions, the first portion at least partially removable from the second portion, and the fluid-retaining chamber, siphoning element and enclosure are contained in the first portion.

11. A method comprising:

introducing a first liquid into a fluid-retaining chamber of an additive dispenser of a washing machine, wherein the washing machine comprises a washing chamber and one or more water inputs, the additive dispenser is coupled to the one or more water inputs and is configured so that an outfall of the additive dispenser can flow into the washing chamber, the fluid-retaining chamber includes a bottom surface and an opening for receiving water supplied by the one or more water inputs, the fluid-retaining chamber comprises a siphoning element coupled to the bottom surface and extending upward therefrom, the siphoning element including an upper portion and a fluid pathway from the upper portion to a region external to the fluid-retaining chamber, an enclosure is positioned over the siphoning element so as to form a siphon chamber for effecting siphon dispensing of liquid from the fluid-retaining chamber, and the fluid-retaining chamber comprises a porous element having an exposed portion in the bottom surface and is positioned so as to allow liquid remaining in the fluid-retaining chamber following said siphon dispensing to permeate through the porous element and exit the fluid-retaining chamber, wherein the porous element is configured to permit permeation by a first liquid at a first rate and to permit permeation by a mixture of the first liquid and water at a second rate, the first liquid is more viscous than the mixture, and the first rate is slower than the second rate;

introducing water into the fluid-retaining chamber so as to create a liquid mixture;

siphoning a portion of the liquid mixture from the fluid-retaining chamber through the siphoning element; and dispensing another portion of the liquid mixture from the fluid-retaining chamber, after discontinuance of the siphoning, by permeation through the porous element.

12. The method of claim 11, wherein the first liquid is one of liquid detergent and fabric softener.

13. The method of claim 12, wherein the porous element comprises at least one of a filter mesh and a permeable membrane.

* * * * *